United States Patent [19]

Hargett et al.

[11] Patent Number: 4,591,226

[45] Date of Patent: May 27, 1986

[54] ANNULAR ELECTRICAL CONNECTORS FOR DRILL STRING

[75] Inventors: Hoke S. Hargett; Charles E. Barton, both of Houston; William D. Boles, Kingwood, all of Tex.

[73] Assignee: NL Industries, Inc., New York, N.Y.

[21] Appl. No.: 462,662

[22] Filed: Jan. 31, 1983

[51] Int. Cl.[4] ..... H01R 4/64

[52] U.S. Cl. ..... 339/117 R; 339/16 C

[58] Field of Search ..... 339/15, 16 R, 16 C, 339/94 AU, 117 R, 64 R, 14; 166/209, 217

[56] References Cited

U.S. PATENT DOCUMENTS

| | | | |
|---|---|---|---|
| 2,301,783 | 10/1942 | Lee | 339/16 R |
| 2,706,616 | 4/1955 | Osmon | 339/16 R |
| 2,966,216 | 12/1960 | Bigelow | 166/217 X |
| 3,170,137 | 2/1965 | Brandt | 339/16 R |
| 3,518,608 | 6/1970 | Papadopoulos | 339/16 |
| 3,519,975 | 7/1970 | Prow et al. | 339/94 M X |
| 3,678,441 | 7/1972 | Upstone et al. | 339/94 R |
| 3,696,332 | 10/1972 | Dickson, Jr. | 340/18 LD |
| 3,879,097 | 4/1975 | Oertle | 339/16 R |
| 3,980,369 | 9/1976 | Panek | 339/117 R X |
| 3,989,330 | 11/1976 | Cullen | 339/16 R |
| 4,012,092 | 3/1977 | Godbey | 339/16 R |
| 4,051,456 | 9/1977 | Heilhecker | 340/18 LD |
| 4,085,993 | 4/1978 | Cairns | 339/94 M |
| 4,220,381 | 9/1980 | Van Der Graaf | 339/16 C |

OTHER PUBLICATIONS

"Applying Wet Connectors", by Jeffrey V. Wilson, *Ocean Industry,* 1978, pp. 125–133.

Brochure of Down-Hole Communications Company, Mar. 1978.

Brochure entitled "Crouse-Hinds Electro", pp. 18 and 24, Apr. 1979.

*Primary Examiner*—Eugene F. Desmond

*Attorney, Agent, or Firm*—Browning, Bushman, Zamecki & Anderson

[57] ABSTRACT

The invention pertains to an electrical communication system for a well conduit. The system includes annular male and female electrical coupler assemblies, holders for releasably mounting the coupler assemblies generally coaxially in opposite ends of a section of well conduit, and a cable assembly connected to the coupler assemblies for conducting electric current therebetween.

46 Claims, 15 Drawing Figures

16
50
52
18a
22
24
18
10
4
4
18d
20
14
18d
28
26
18b
48
58
32
6
6
54
34
56
12a
46
10a
40
38
42
70
66
44
64
68
38'
46'
60
28'
34'
58
32
48'
26
14'
18a
18d
20
72
74
18b
18d
24
18
22
62
12

FIG. 4
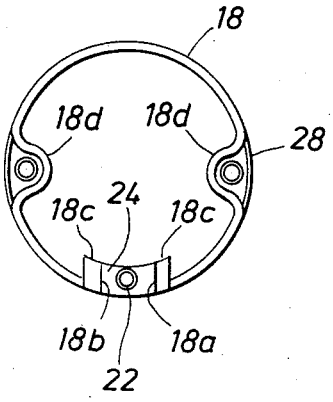
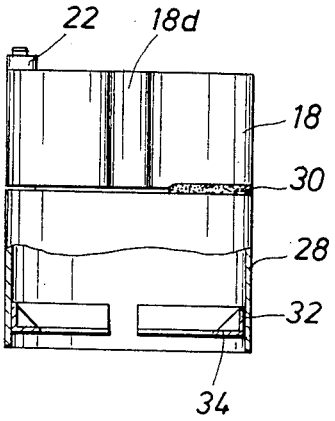
FIG. 5
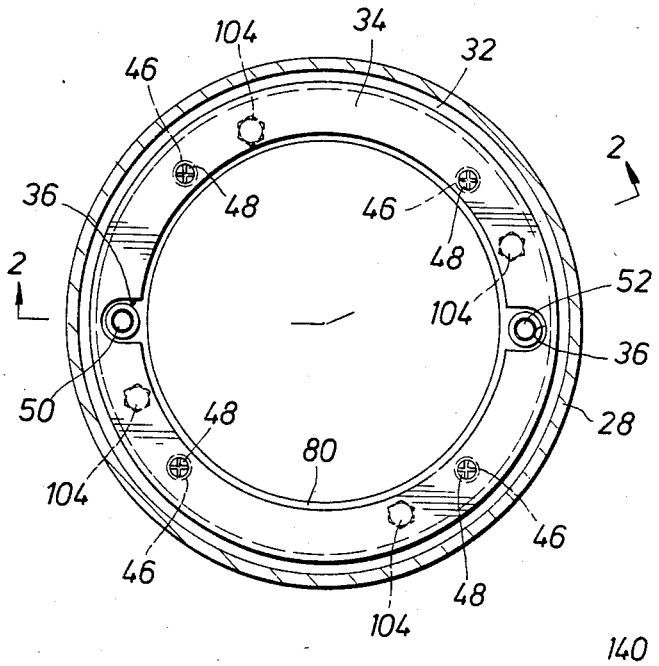
FIG. 6
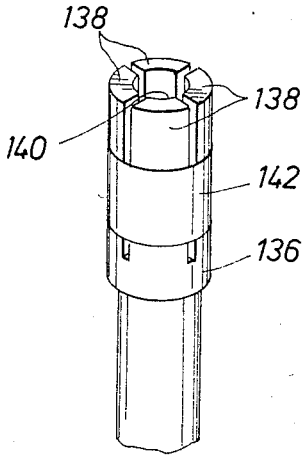
FIG. 7

FIG. 14
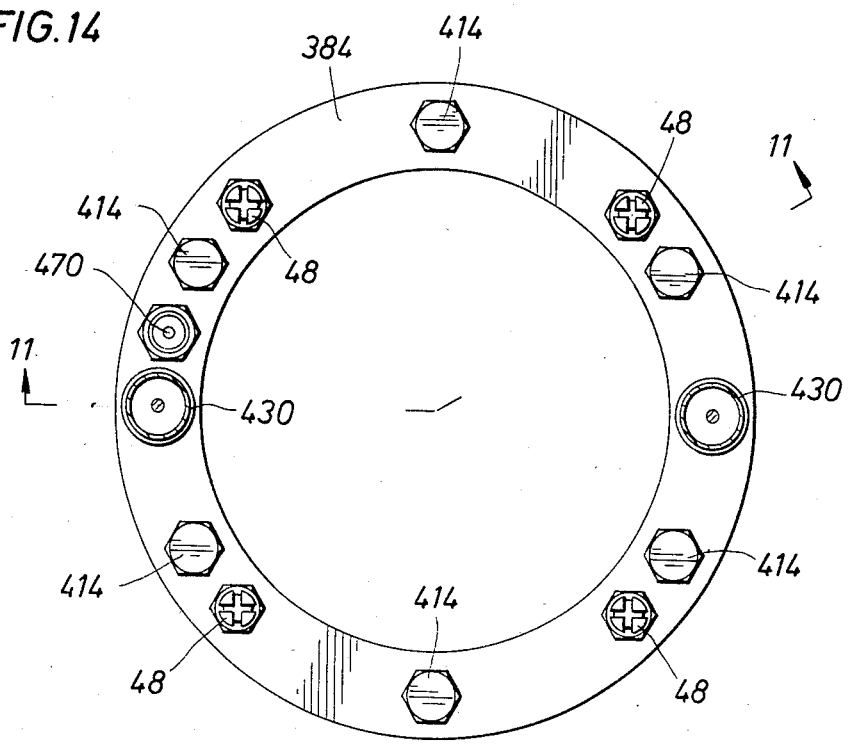
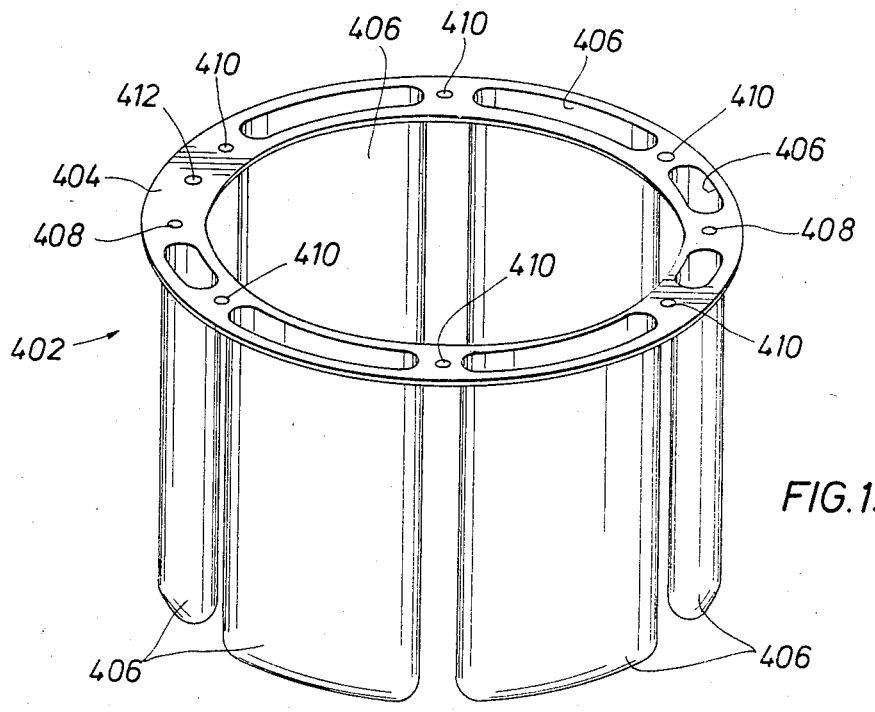
FIG. 15

ANNULAR ELECTRICAL CONNECTORS FOR DRILL STRING

BACKGROUND OF THE INVENTION

The invention pertains to apparatus for making electrical connections along a well conduit, although certain features of the invention are also applicable to electrical connection apparatus used in other contexts, and other features of the invention are applicable to the mounting of various other types of devices or systems in well conduits.

It is often necessary, for one reason or another, to transmit an electric current along the length of a well conduit. Typically, such current is transmitted along a drill string during drilling of the well. For example, there may be electronic apparatus located near the drill bit for taking readings of various parameters such as downhole physical and/or chemical conditions and/or directional drilling information. Such devices produce signals which are electrically transmitted along the drill string to the top of the well for communication to the operator, while power for operating these devices and/or electrical control signals are transmitted downwardly along the drill string.

Various systems currently available for providing such electrical communication along a well conduit each suffer from respective disadvantages. Some such systems employ more or less conventional pin and socket type electrical couplers mounted in centralized positions within the central bore of the drill string. See U.S. Pat. No. 4,051,456. The major disadvantage of these systems is that they prevent running of wire line tools through the drill string.

Other systems involve electrical apparatus built into the sections of drill stem themselves. For example, systems disclosed in U.S. Pat. No. 3,696,332, No. 3,518,608 and No. 3,879,097 employ electrical contacts embedded in the seal shoulders or pins and boxes of the drill stems and electric conductors extending through the side walls of such stems. Such systems minimize obstruction of the bore of the drill string. Also, because the contacts are located on the seal shoulders or threaded portions of the drill stems, they are automatically connected as the string is made up, and furthermore, are fairly well protected against contact with the drilling fluid. However, a major disadvantage of these systems is that they are expensive, requiring special manufacture of the drill stem sections to be used in the operations in question.

Other systems ae designed to be installed in standard pipe sections, e.g. U.S. Pat. No. 4,012,092, but require special apparatus for such installation.

Still other systems have attempted to provide for field installation. However, they still require at least some special machining of the drill stems to be used.

Another problem which arises with electrical couplers used downhole and/or in deep underwater environments is that of adequately protecting such contacts against exposure to the fluids in those environments. In downhole applications, it is particularly important to avoid exposure of the contacts to the drilling fluid for several reasons. Probably the most important reason is that typical drilling fluids themselves have conductive properties. Another is that a clean contact will make a better connection with its mate. Finally, the drilling fluid, salt water, and/or other fluids encountered in such environments may be corrosive or otherwise harmful to preferred contact materials, particularly at the high temperatures of those environments.

SUMMARY OF THE INVENTION

It is a principal object of the present invention to provide electrical communication apparatus which may be easily field installed in standard drill stems or other well conduit sections and including annular coupler assemblies designed to be automatically matingly engaged when the sections of drill stems are connected to one another.

Another object of the invention is to provide improved annular electrical coupler assemblies.

A further object of the invention is to provide electrical coupler assemblies with improved sealing means.

Still another object of the present invention is to provide means for mounting such coupler assemblies, or other suitable devices, within the bore of a section of well conduit without the need for any special machining of the latter.

These and other objects of the present invention will become apparent from the drawings, the description given herein, and the appended claims.

The system of the present invention includes generally annular male and female electrical coupler assemblies and respective mounting means for releasably mounting the coupler assemblies coaxially within opposite ends of a section of well conduit. The two coupler assemblies thus mounted on each section of well conduit are interconnected by electrical transfer means in the form of at least one, and preferably two, cable assemblies. As mentioned, the coupler assemblies, including their respective electrical contacts, are generally annular. The mounting means are also generally annular so that the apparatus does not unduly obstruct the bore of the well conduit.

Various features of the system contribute to its ability to be easily field mounted in virtually any standard type drill stem without the need for any special machining or other preparation of the latter. The mounting means are adapted for connection to the bore of a section of well conduit by a frictional interference connection. This eliminates the need for any special mounting formation on the conduit section itself. The mounting means is also capable of accommodating the usual tolerances or variations in inner diameter which occurs in standard drill stems of any given size.

The cable assemblies, on the other hand, are longitudinally extendable so that they may accommodate longitudinal size variations in the drill stem sections, as well as stretching of the drill stems during use. Nevertheless, the construction of the cable assemblies, together with the manner in which they are connected to the coupler assemblies, serves to retain them adjacent the inner diameter of the drill stem bore. Thus the cable assemblies are prevented from obstructing that bore, yet there is no special machining or other modification of the drill stem necessary to accomplish this purpose.

The coupler assemblies themselves are so designed and so positioned on the drill stem that they will be automatically matingly engaged as the drill stem is made up. At least one of the coupler assemblies of each mating pair includes a base structure and annular contact means mounted on that base structure for limited lateral and circumferential play. Such play not only accommodates ordinary deviations in the bore centerline location from one drill stem to the next, but also the looseness and relative movement of the mating tool joints before they are fully made up. Preferably, this same coupler assembly of each pair is mounted for limited longitudinal play to insure full mating engagement of the contact means of the coupler assemblies.

The invention also comprises several embodiments of improved contact means and sealing sysems therefor, some of which are also advantageously applicable to other types of contacts. Likewise, the improved mounting means described above can be used to advantage to mount various devices other than electrical coupler assemblies within the bore of a well conduit, particularly where such devices are annular.

Among the other advantages of the invention are that it permits positioning of the couplers so as to be protected by the drill pipe, while still permitting automatic make up, the latter further being independent of the position of the drill pipe in the string. The couplers are also arranged to direct drilling mud away from the contact surfaces during back out and vertical storage. Still other features and advantages of the invention will be brought out in the detailed description below.

BRIEF DESCRIPTION OF THE DRAWINGS

FIG. 4 is an end elevational view of one of the mounting assemblies taken along line 4—4 in FIG. 1.

FIG. 5 is a side elevational view, with part broken away, of a mounting assembly taken at a right angle to the view of FIG. 1.

FIG. 6 is a transverse view of the mounting means and one coupler assembly taken along the line 6—6 in FIG. 1.

FIG. 7 is an enlarged detailed perspective view of one of the cable connections.

FIG. 14 is an end view of the male coupler assembly of the third embodiment of the invention taken along the line 14—14 of FIG. 11.

FIG. 15 is a perspective view of the diaphragm of the male coupler assembly of FIG. 11.

DESCRIPTION OF PREFERRED EMBODIMENTS

Figure 1:
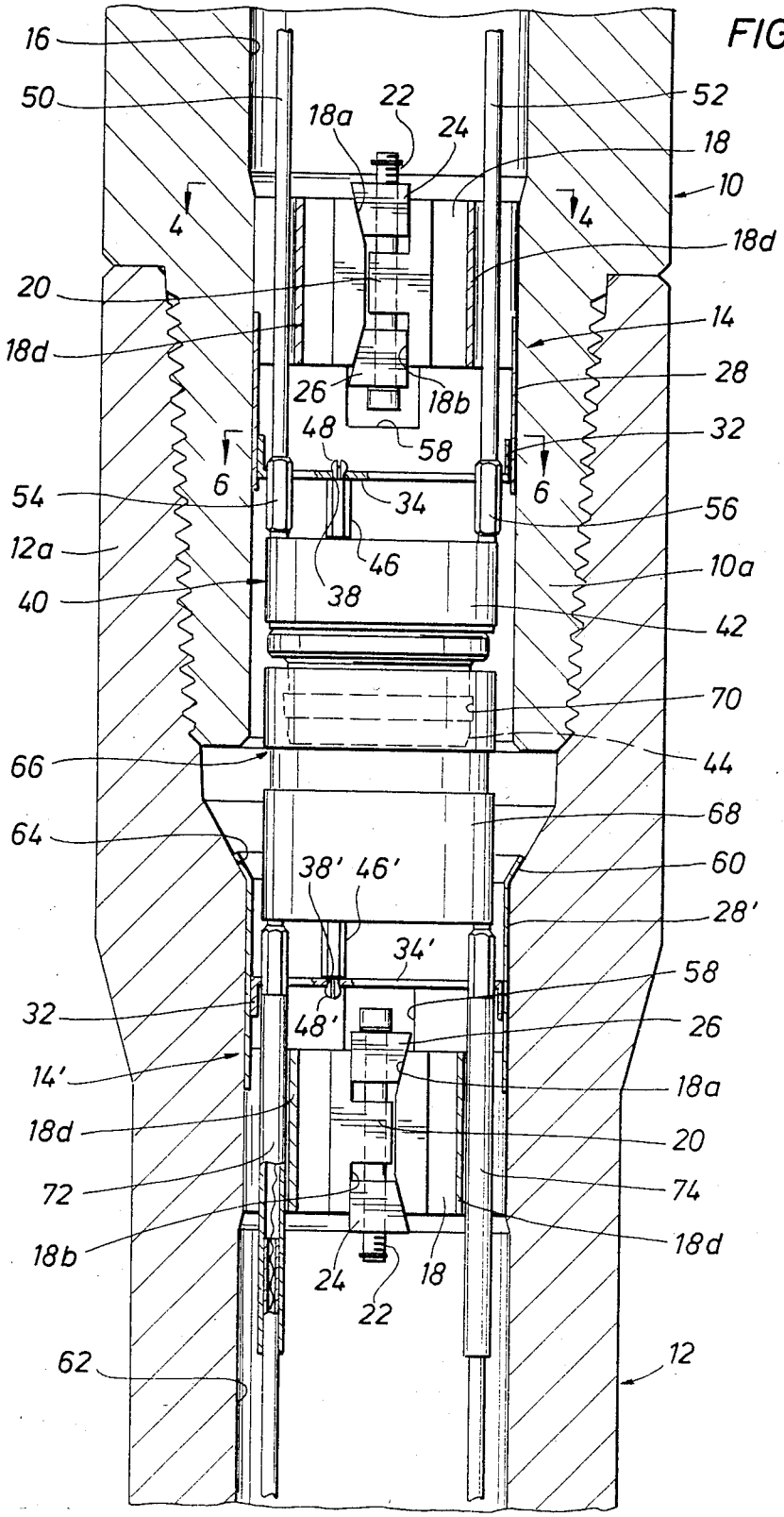
FIG. 1 is a longitudinal cross-sectional view through a pair of mated drill stem tool joints showing mounting means and mated electrical coupler assemblies according to the invention.

FIG. 1 is a longitudinal cross-sectional view taken through a portion of a drill string, more specifically, through the threadedly connected pin 10*a* and box 12*a* of two adjacent sections of drill stem 10 and 12 respectively. As is well known in the art, stem sections 10 and 12 would be a part of a drill string extending from a rig downwardly through a well to the drill bit. Such a drill string is a prime example of the type of apparatus to which the present invention is applied, as it is frequently necessary or at least desirable to transmit electric current from the rig to the bit and/or vice versa along the drill string. For example, such apparatus may be used to transmit signals from electronic devices located near the bit to inform the operator of various downhole conditions. Current may be transmitted downwardly along the drill string to power such devices and/or to convey control signals to them. However, while the invention will be described in detail as it pertains to such drill string applications, it should be borne in mind that the invention could likewise be applied to other types of well conduits. Also, at least some aspects of the invention are applicable to the electrical couplers and/or communication systems in general.

Referring again to FIG. 1, a first mounting assembly generally indicated by the numeral 14 is releasably secured within the central bore 16 of drill stem 10 generally adjacent the base end of pin 10*a*. Referring now to FIGS. 4–6 along with FIG. 1, the mounting assembly 14 includes a split grip sleeve 18 which is adapted to be releasably secured in bore 16 by a frictional interference fit. Ring 18 has opposed split edges 18*a* and 18*b*, and its radial thickness is increased adjacent said split edges as indicated at 18*c*. Edge 18*b* is cut away adjacent the upper and lower ends of ring 18 to form a central lug member 20 extending toward the opposed edge 18*a*. Lug 20 has a longitudinal throughbore which receives a bolt 22. Bolt 22 is threadedly received in a pair of wedge elements 24 and 26 located respectively above and below lug 20 in the cut away areas of split sleeve edge 18*b*. Sleeve edge 18*a* has its upper and lower portions tapered longitudinally outwardly away from edge 18*b* generally opposite respective ones of the cut away areas of edge 18*b*. Each of the wedge elements 24 and 26 has a straight longitudinal edge for sliding engagement with edge 18*b* and an opposite tapered edge for sliding engagement with a respective one of the tapered portions of edge 18*a*. Accordingly, by tightening bolt 22, wedge elements 24 and 26 can be urged longitudinally toward each other. This wedges each of the elements 24 and 26 into the space defined between the respective cut away area of edge 18*b* and the opposed tapered area of edge 18*a* thereby forcing the edges 18*a* and 18*b* of sleeve 18 circumferentially away from each other. This in turn expands sleeve 18 radially against bore 16 for a firm frictional interference fit. This action of sleeve 18 is facilitated by the fact that said sleeve has formed therein a pair of radially inwardly projecting convolutions 18*d* diametrically opposed to each other and located at approximately 90 degrees from the split in sleeve 18. Convolutions 18*d* help to give sleeve 18 a spring-like quality and also serve as locator sleeves receiving a pair of cable assemblies to be described more fully below.

It can be appreciated that, among other advantages, this mounting arrangement allows for a wide placement range and a large preload force. Furthermore, while elastic, the grip sleeve 18 provides a firm attachment which will not readily yield when loaded. The mounting assembly 14 further includes an attachment ring 28 secured to ring 18 and extending longitudinally therefrom toward the outer end of pin 10*a* of the drill stem section 10. Because ring 28 is not split, but rather continuous, it is welded to ring 18 about only a portion of its circumference generally opposite split edges 18*a* and 18*b* as indicated at 30 in FIG. 5. Attachment ring 28 has a longitudinal recess 58 for accommodating wedge element 26 and the head end of bolt 22. Mounted in ring 28 is a fixture comprising a cylindrical wall 32 welded to the interior of attachment ring 28 and an annular flange or self 34 extending radially inwardly from wall 32. Shelf 34 has cut away areas 36 for receipt of the cable assembly described below and four socket apertures 38 extending longitudinally therethrough at symmetrically circumferentially spaced locations.

A male coupler assembly generally indicated by the numeral 40 is removably attached to shelf 34 and extends longitudinally therefrom toward the outer end of pin 10*a* of drill stem section 10. Coupler assembly 40 includes an annular base structure 42 on which is mounted an electrical contact means 34. Extending longitudinally from the end of base structure 42 opposite contact means 34 are four symmetrically circumferentially spaced standoff projections 46. Each projection 46 has a snap 48 at its outer end. Snaps 48, which will be discussed more fully below, are each received in a respective one of the socket apertures 38 to mount coupler assembly 40 on mounting assembly 14. A pair of cable assemblies 50 and 52 are attached to coupler assembly 40 at diametrically opposed locations by their respective cable fittings 54 and 56. The cable assemblies 50 and 52 extend through respective ones of the cut away areas 36 in shelf 34 as well as through respective ones of the convolutions 18*d* in split sleeve 18, said convolutions serving to help locate cable assemblies 50 and 52 in opposed locations adjacent the surface of bore 16.

A second mounting assembly 14' is removably secured within the bore 52 of drill stem 12 just below box 12*a*. Assembly 14' differs from assembly 14 only in its direction of orientation and in certain details of its attachment sleeve 28'. Specifically, sleeve 28' has at its longitudinally outer end a radially outwardly flared flange 60 for locating assembly 14' on a bevelled surface 64 in bore 62 at the base end of box 12*a*. Also, the shelf 34' of assembly 14' is located further from the outer end of attachment ring 28', than is shelf 34 with respect to ring 28 of assembly 14. Otherwise, the parts of assembly 14' are identical to the parts of assembly 14. Therefore, these parts have been given corresponding reference numerals and will not be described in detail herein.

A female electrical coupler assembly 66 is removably secured to mounting assembly 14' in the same manner in which coupler assembly 40 is secured to mounting assembly 14, namely by snaps 48' on standoff projections 46' extending longitudinally away from the base structure 68 of assembly 66 and received in socket apertures 38' through shelf 34'. Coupler assembly 66 includes a female contact means generally indicated at 70 which matingly receives male contact means 44 of coupler assembly 40 when pin 10*a* and box 12*a* of the drill stem sections are engaged. More specifically, because both contact means are annular, and mounted concentrically with box 12*a* and pin 10*a*, they will be automatically matingly engaged as the connection between the pin and box is made up.

It should be understood that cable assemblies 50 and 52 extend from male coupler assembly 40 upwardly along drill stem section 10 and are connected to a female coupler assembly identical to assembly 66 mounted in the upper end of section 10. Female coupler assembly 66 has cable assemblies 72 and 74 attached thereto and extending downwardly to a male coupler assembly identical to assembly 40 but mounted in the lower end of drill stem section 12. This same scheme is repeated throughout the drill string so that electric current can be transmitted therealong.

Figure 2:
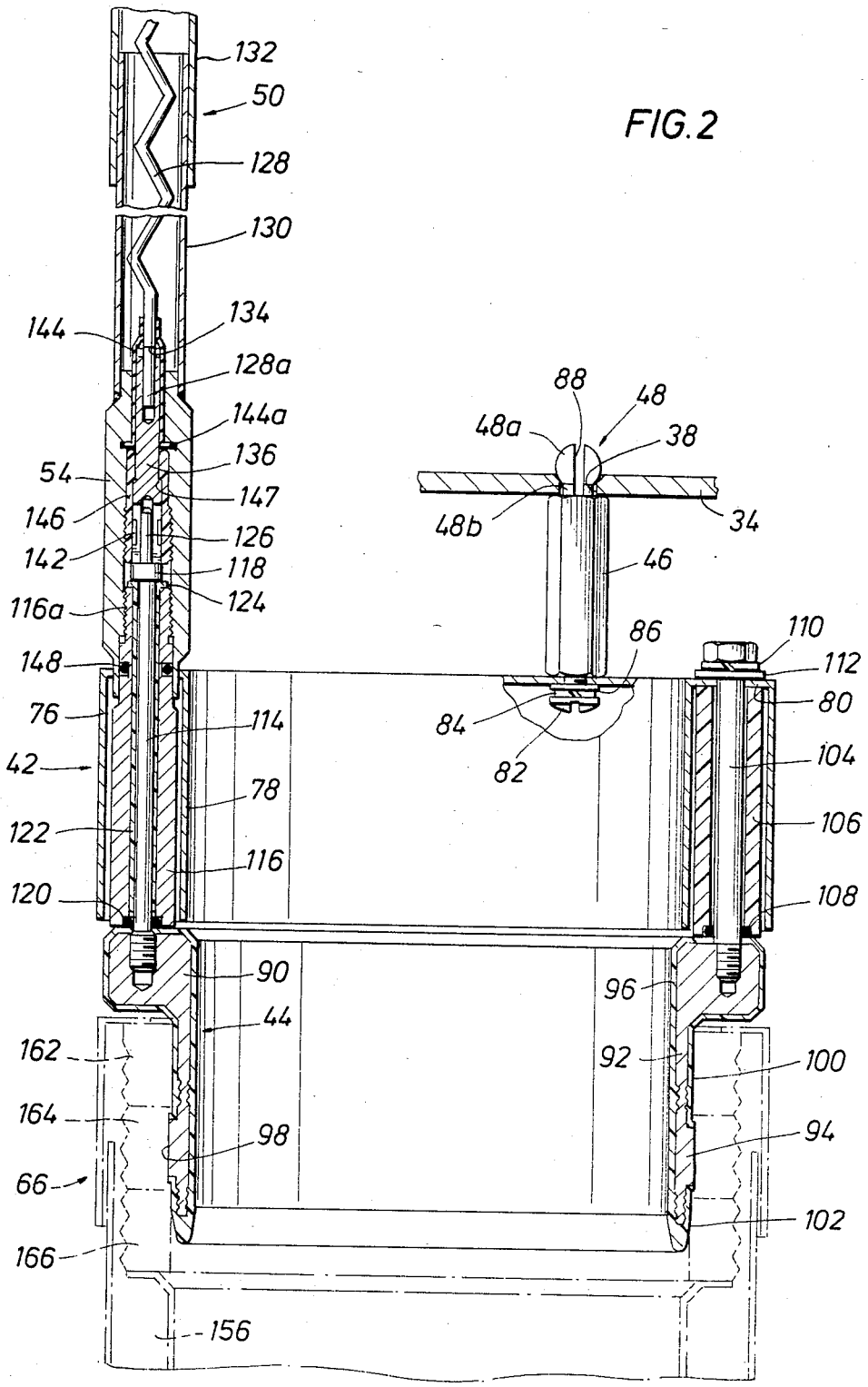
FIG. 2 is a longitudinal cross-sectional view taken along the line 2—2 in FIG. 6 through the male coupler assembly of a first embodiment of the invention.

Referring now to FIG. 2, in conjunction with FIG. 6, male coupler assembly 40 is shown in greater detail. The base structure 42 of the male coupler assembly includes a pair of radially spaced apart concentric cylindrical walls 76 and 78. The ends of walls 76 and 78 distal contact means 44 are joined by an annular plate 80. Plate 80 provides a site for attachment of projections 46. Each projection 46 is attached to plate 80 by a screw 82, a lock nut 84 and a washer 86 being interposed between the head of screw 82 and plate 80. FIG. 2 also shows one of the snaps 48 in greater detail. This snap includes a ball detent 48*a* and a neck portion 48*b* of lesser diameter than ball detent 48*a* and connecting said ball detent to the main body 46 of the projection. Snap 48 has a pair of crossed slits extending longitudinally therethrough, one such slit being shows at 88, to divide snap 48 into four spring-like fingers. These fingers can be deflected laterally toward one another from the relaxed position shown in FIG. 2. Socket aperture 38 in shelf 34 has a diameter less than that of ball detent 48*a* in its relaxed position, but slightly greater than that of neck portion 48*b*. Thus, by deflection of its four fingers, ball detent 48*a*can be forced through socket 38 and will then return to its relaxed position to retain neck portion 48*b* within said socket until forceably removed.

Male contact means 44 comprises a conductive contact ring having a thickened end portion 90 and a thin sleeve portion 92 extending longitudinally away from the inner periphery of thickened portion 90. Sleeve portion 92 has an external annular upset 94 located slightly longitudinally inwardly from the free end of sleeve portion 92. Contact ring 90, 92, 94 is encased in a layer 96 of insulating material except over the annular radially outwardly facing surface area 98 defined by upset 94. Accordingly, surface 98 provides an annular contact area interposed longitudinally between annular insulated areas 100 and 102 on the radially outer surface of contact means 44.

Contact means 44 is mounted on base structure 42 by four bolts 104 formed of a strong but nonconductive material such as exoxy. Although bolts 104 are symmetrically circumferentially spaced from one another, only one is seen in FIG. 2, the section of FIG. 2 being taken in two planes—as indicated in FIG. 6—to show the conductive path described below. Referring again to FIG. 2, the bolt 104 has its head located outwardly of plate 80 and a smooth central portion of its shank extending through plate 80 and also through the space between walls 76 and 78 of the base structure and a suitable bore in insulation 96, the end of the bolt being threaded into thickened portion 90 of the contact ring. A rigid sleeve 106 of insulating material disposed between walls 76 and 78 surrounds the smooth shank portion of bolt 104 to help position the bolt within the base structure, sleeve 106 being sealed with respect to bolt 104 by an O-ring 108. A lock nut 110 and a washer 112 are disposed between the head of bolt 104 and plate 80 to retain the bolt properly in place.

The left hand side of FIG. 2 shows the connection between cable assembly 50 and the coupler assembly, and it should be understood that cable assembly 52 is connected in the same manner. Preferably, the two cable assemblies form redundant electrical paths to and from contact ring 90, 92, 94 so that proper electrical communication can be maintained even if one of the cable assemblies is damaged. Of course, it will be understood as within the skill of the art to provide means (not shown) for preventing a failure in one of the two parallel electrical paths from causing a "short" in the other. A conductive bolt 114 is threaded into the thickened portion 90 of the contact ring and extends through insulation 96, between base structure walls 76 and 78 and outwardly through an opening in plate 80. A connector sleeve 116 surrounds bolt 114 and extends therealong from the end of the contact ring and through the base structure to a point just below a flange 118 on bolt 114. Bolt 114 is sealed with respect to connector sleeve 116 by an O-ring 120 and is insulated from connector sleeve 116 by an insulator sleeve 122 having a radially outwardly extending flange 124 on its end for disposition between the outer end of connector sleeve 116 and the underside of flange 118 of bolt 114. Sleeve 116 is thus clamped between flange 118 and thickened portion 90 of the contact ring. The outer portion of connector sleeve 116 is externally threaded as indicated at 116*a*. A conductive pin 126 which forms a continuation of bolt 114 extends outwardly beyond connector sleeve 116.

Cable assembly 50 includes the cable proper 128 and a pair of telescoping shield tubes 130 and 132 surrounding cable 128 over the major portion of its length. The inner diameters of tubes 130 and 132 are substantially wider than cable 128, whereby the latter can be folded upon itself within the tubes as shown. As used herein, "folded upon itself" will be broadly construed to cover arrangements in which the cable is accordion folded, as shown, coiled, telescoped, etc. This arrangement permits for longitudinal extension and retraction of the cable assembly to accommodate drill stem sections of varying lengths, as well as the stretching of such drill stems in use. Yet, the rigidity of tubes 130 and 132 ensures that the cable assemblies will remain laterally displaced from the centerline of the drill stem and adjacent its inner bore surface. Thus the cable assemblies neither obstruct the bore nor are unduly vulnerable to damage to themselves should it be desired to run a wire line tool through the drill string. In alternative embodiments, the tubes could be formed of somewhat less rigid materials with reinforcing or bracing means.

Cable 128 is insulated up to a point 134 near its end. The uninsulated portion 128*a* of cable 128 extending beyond point 134 has a conductive link member 136 attached thereto. A socket at one end of member 136 is crimped about uninsulated cable end 128*a*. The other end of member 136 forms a split socket, better shown in FIG. 7, for receipt of pin 126 of the coupler assembly. Referring to FIG. 7, the four fingers 138 forming the split socket 140 are urged toward each other by a spring band 142 for tight engagement about pin 126.

A female connection fitting 54 is welded to the end of tube 130 and generally surrounds link member 136. Fitting 54 has a threaded end portion extending beyond member 136 for connection to threaded portion 116*a* of connector sleeve 116 as shown. Fitting 54 and connector sleeve 116 are sealed by O-ring 148. A sleeve-like elastomeric insulator boot 144 has one end secured in surrounding relation to the insulated portion of cable 128 near point 134 and extends between link member 136 and fitting 54, a flange 144*a* at the other end of boot 144 extending into an internal annular groove in fitting 54. Boot 144 partially insulates link member 136 from fitting 54 and protects the link member and uninsulated cable end from contact with drilling fluid. The remainder of link member 136 is insulated from fitting 54 by a rigid insulator sleeve 146 threaded into the bore of fitting 54 and abutting the flanged end 144*a* of boot 144 therein to retain boot 144 within fitting 54. Insulator sleeve 146 is sized to also abut the shoulder formed on the upper side of flange 118 of bolt 114, and has an internal shoulder 147 which engages a mating shoulder on link member 136 to retain the latter in fitting 54.

It can thus be seen that cable 128, link member 136, and pin 126, through the integral flange 118 and bolt 114, provide a conductive path behind contact ring 90, 92, 94 and a female contact located at the opposite end of cable assembly 50. As previously mentioned, the telescoping arrangement of tubes 130 and 132 together with the folding of cable 128 therein allows the male and female coupler assemblies connected to cable assembly 50 to be spaced at different distances to accommodate drill stems of different lengths and/or stretching of the drill stem in use. However, fitting 54 is rigidly connected to connector sleeve 116 independently of cable 128, sleeve 116 in turn being fixed with respect to contact ring 90, 92, 94 by rigid bolt 114 and its flange 118. Thus, any forces imposed on tubes 130 and 132, either during longitudinal extension and retraction of cable assembly 50 as described above or otherwise, are transmitted directly to the male coupler assembly without the imposition of any substantial forces on cable 128. Thus, the arrangement protects the cable and the integrity of its electrical connection.

Figure 3:
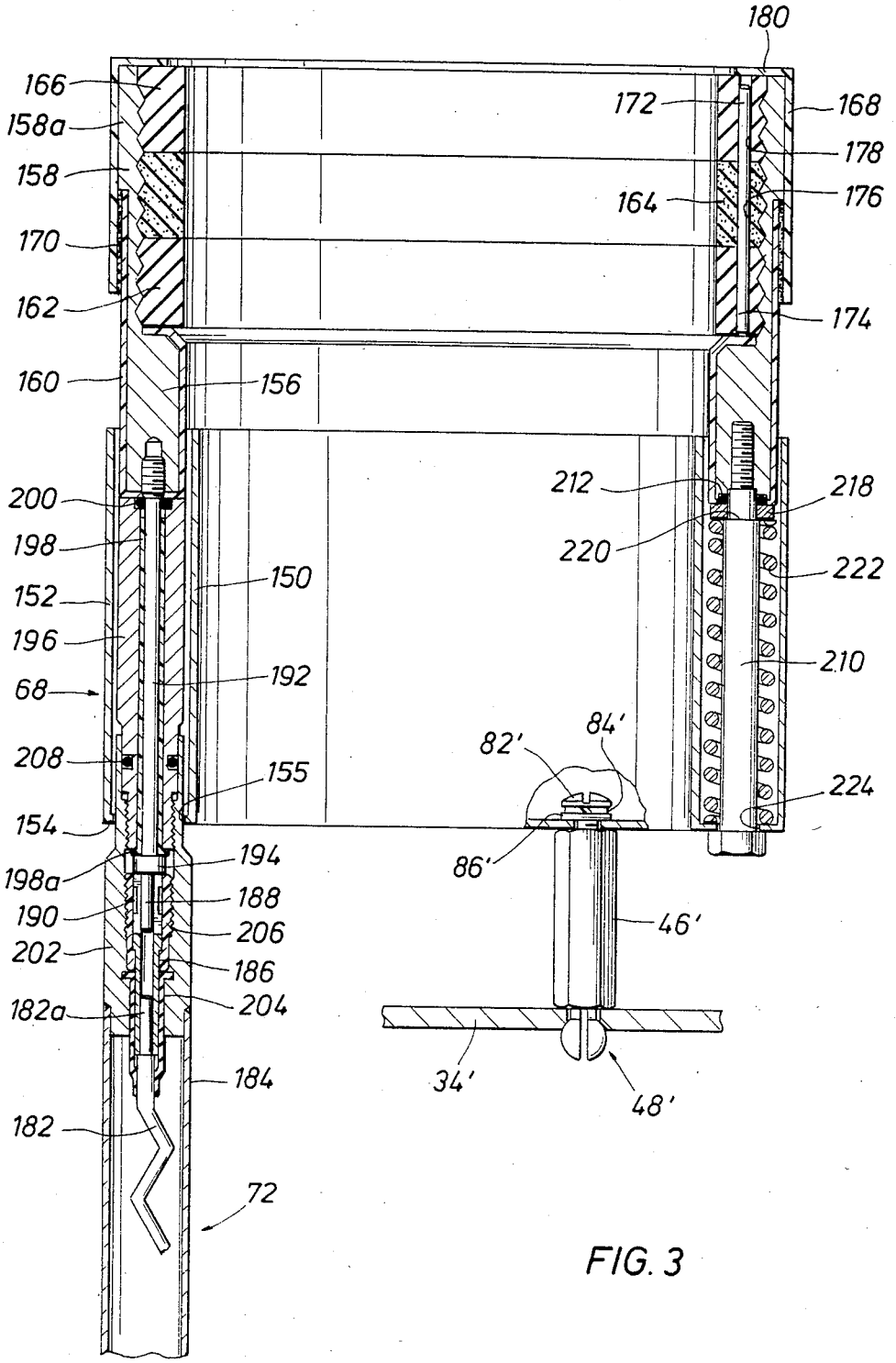
FIG. 3 is a view similar to that of FIG. 2 through the female coupler assembly of the first embodiment of the invention.

Referring now to FIG. 3, there is shown a female coupler assembly of the type designed to mate with the male assembly of FIG. 2. As previously mentioned, in use, one such female assembly would be mounted within the drill stem section adjacent that of the male assembly to mate with the latter as indicated in phantom at 66 in FIG. 2, while an identical female coupler assembly would be attached to the male assembly of FIG. 2 by cable assemblies 50 and 52 and mounted within the opposite end of the same section of drill stem for mating engagement with a male assembly in the drill stem section above, and this scheme would be repeated throughout the drill string.

As noted above, the female coupler assembly of FIG. 3 includes a base structure generally indicated by the numeral 68. Base structure 68 is similar to the base structure of the corresponding male coupler assembly in that it includes concentric, spaced apart, cylindrical walls 150 and 152, the ends of which are joined by a horizontal annular plate 154. The standoff projections 46' and snaps 48' for the female coupler assembly are identical to parts 46 and 48 of the male coupler assembly and are similarly joined to plate 154 by a screw 82', a lock washer 84' and a flat washer 86' being disposed between the head of the screw and plate 154.

The contact means of the female coupler assembly include a generally rigid metal contact ring including a thickened annular portion 156 adjacent the base structure 68 and a sleeve-like portion 158 extending longitudinally outwardly from the radially outer periphery of thickened portion 156. An insulating casing 160 covers the outer surfaces of thickened portion 156 of the contact ring and extends outwardly along the radially outer surface of sleeve-like portion 158 to an externally upset area 158*a* thereof. Three elastomeric annuluses 162, 164 and 166 are stacked end-to-end along the radially inner surface of sleeve-like portion 158 of the contact ring. The abutting surfaces of sleeve-like portion 158 and the annuluses 162, 164 and 166 are serrated as shown to help maintain the annuluses in proper position. The longitudinally inner and outer annuluses 162 and 166 are insulators, while the middle annulus 164 is a conductive elastomeric annulus, e.g. comprised of a suitable natural or synthetic rubber impregnated with metal particles. Thus, the annulus 164, which is in direct electrical contact with sleeve-like portion 158 of the contact ring, forms a part of the contact means of female coupler assembly.

The annuluses 162, 164 and 166 each have a plurality of circumferentially spaced bores extending longitudinally therethrough, three such bores being shown at 174, 176 and 178. The bores of the three elastomeric annuluses are longitudinally aligned, so that a wire can be inserted through each set of three aligned bores as shown at 172. Wire 172 helps to maintain the annuluses in the proper position. A retainer sleeve 168 extends along the upset area 158*a* on the radially outer side of sleeve-like portion 158 of the contact ring and overlaps the adjacent portion of the insulator casing 150, the overlapping portions being bonded together by a suitable adhesive 170. Sleeve 168 is formed of a relatively rigid insulating material such as a suitable plastic, and has an annular flange 180 extending radially inwardly from its outermost end partially across the end of insulator annulus 166. Flange 180 retains annulus 166 and wire 170 in place. It can thus be seen that the contact means is completely insulated except for the annular contact area defined by the radially inner surface of conductive annulus 164.

The cable assemblies, one of which is shown at 72, are connected to the female assembly of FIG. 3 in substantially the same manner as cable assembly 50 is connected to the male coupler assembly. Briefly, cable assembly 72 includes the cable proper 182 which is folded upon itself within a pair of telescoping shield tubes, one of which is shown at 184. A conductive link member 186 has a socket at one end crimped about the uninsulated end portion 182*a* of cable 182 and a split socket at its other end urged about a conductive pin 188 received therein by a spring ring 190. Pin 188 is integral with a conductive bolt 192 which extends through an opening 155 in plate 154 of base structure 68, through the area between walls 150 and 152, and through insulation 160, and is threaded into thickened portion 156 of the contact ring. A flange 194 extends radially outwardly at the juncture of pin 188 and the main body of bolt 192. A metal connector sleeve 196 surrounds the portion of bolt 192 between flange 194 and thickened portion 156 of the contact ring and is insulated therefrom by a sleeve 198 having a flange 198*a* disposed between flange 194 of bolt 192 and the end of connector sleeve 196. Bolt 192 is also sealed with respect to connector sleeve 196 adjacent the contact ring by an O-ring 200. A fitting 202 is welded to the end of tube 184 of the cable assembly 72 and threaded to the outer end of connector sleeve 196. Link member 186 is insulated from fitting 202 by an elastomeric boot 204, also connected to the end of cable 182, and by a sleeve 206 threaded into fitting 202 and supporting link member 186 therein. The end of fitting 202 extends through the opening 155 in plate 154 into the area between walls 150 and 152 and is sealed with respect to connector sleeve 196 by an O-ring 208.

Referring to the right hand side of FIG. 3, the contact means and attached parts are mounted on the base structure 68 by a plurality of epoxy bolts, one of which is shown at 210. Each such bolt has its head disposed outwardly of plate 154 and its shank extending through the area between walls 150 and 152, its end being threaded into thickened portion 156 of the contact ring and sealed with respect thereto by an O-ring 212. A rigid ring 218 is clamped between the end of thickened portion 156 of the contact ring and a shoulder 220 formed on bolt 210 to form a shoulder for abutment with one end of a helical compression spring 222 which surrounds bolt 210 within the space between walls 150 and 152 of base structure 68. The other end of spring 222 abuts plate 154 of the base structure. Bolt 210 is free to slide longitudinally in the bore 224 of plate 154 through which it extends. However, spring 222 biases bolt 210 inwardly with respect to the base structure so that the head of the bolt normally abuts plate 154. There are four bolts 210 spaced circumferentially about base structure 68 each biased on a respective such compression spring.

The bolts form a carrier means telescopically mounted on base structure 68 and permitting longitudinally play of the contact ring 156, 158 and attached parts with respect to said base structure. The bores 155 in plate 154 through which connection sleeve 196 and cable fitting 202 extend are large enough to permit these members and the parts associated therewith to likewise move longitudinally with respect to the base structure. Such longitudinal play allows the female coupler assembly to accommodate the longitudinal tolerances in the tool joints while still ensuring full mating engagement with the male coupler assembly as shown in FIG. 2. The clearance between walls 150 and 152 and springs 222 and also between said walls and the connector sleeves 196 further allows for lateral and circumferential play and tilting of contact ring 156, 158 and connected parts with respect to base structure 68, bores 155 and 224 being sufficiently oversized to permit such movement. This not only accommodates the movement of the two sections of drill stem carrying the male and female coupler assemblies as the joint therebetween is being made up, but also allows for difference in the positions of the bore centerlines of the two sections of drill stem while, again, still permitting proper and full mating engagement of the male and female contacts.

Referring again to FIG. 2, it can be seen that, when the coupler assemblies are matingly engaged, the contact area 98 defined by upset 94 on the male contact ring is aligned with and abutting the conductive annulus 164 of the female contact means. The latter is slightly longer longitudinally than contact area 98 to further insure proper electrical contact despite tolerances, slight errors in positioning of the coupler assemblies within the drill stem, debris which may enter between male contact ring portion 90 and the outer end of the female coupler assembly, and the like. However, when the coupler assemblies are matingly enaged, the abutting contact areas are fully insulated and sealed by abutment of insulator annuluses 162 and 166 with insulated areas 100 and 102.

As the male contact means enter the stack of elastomeric annuluses 162, 164, 166, the latter are slightly compressed. This serves several purposes. Firstly, since contact area 98 will pass across the inner surface of insulator annulus 162 before coming into alignment with conductor annulus 164, the former will perform a wiping action on contact area 98 insuring a good connection. The compression of the elastomeric annuluses also insures firm electrical contact between annulus 164 and area 98 and also helps to maintain seals on both sides of the mating contact areas.

Figure 8:
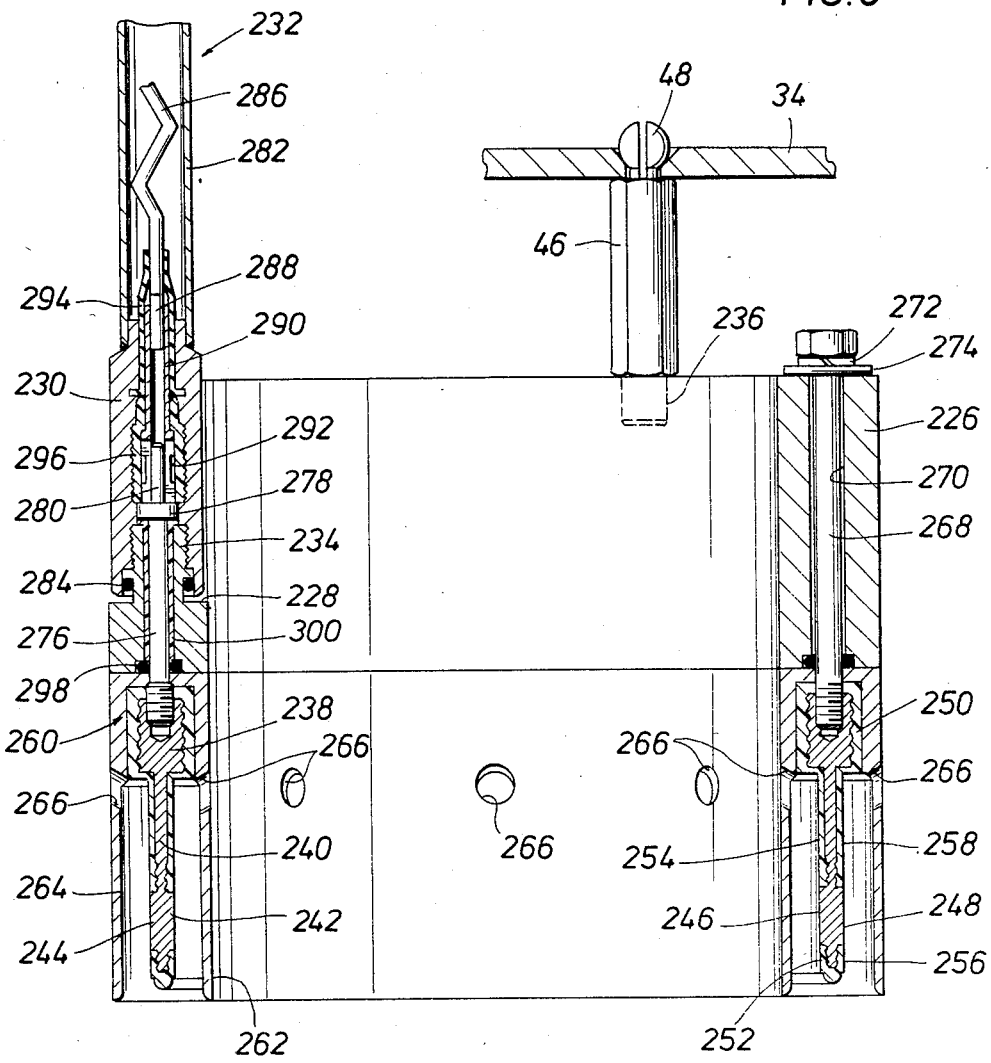
FIG. 8 is a longitudinal cross-sectional view similar to that of FIG. 2 through the male coupler assembly of a second embodiment of the invention.
Figure 9:
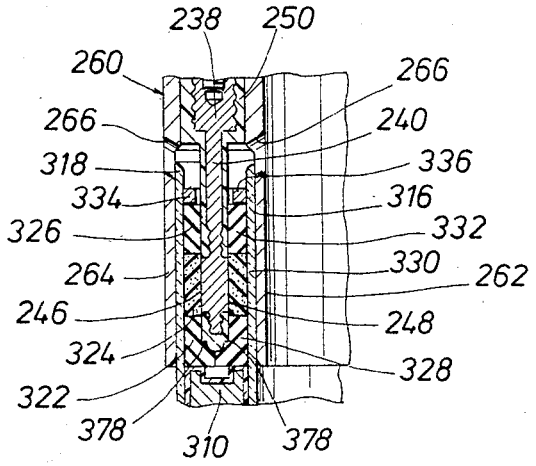
FIG. 9 is an enlarged detailed sectional view of the contact means of FIGS. 8 and 10 in mating engagement.
Figure 10:
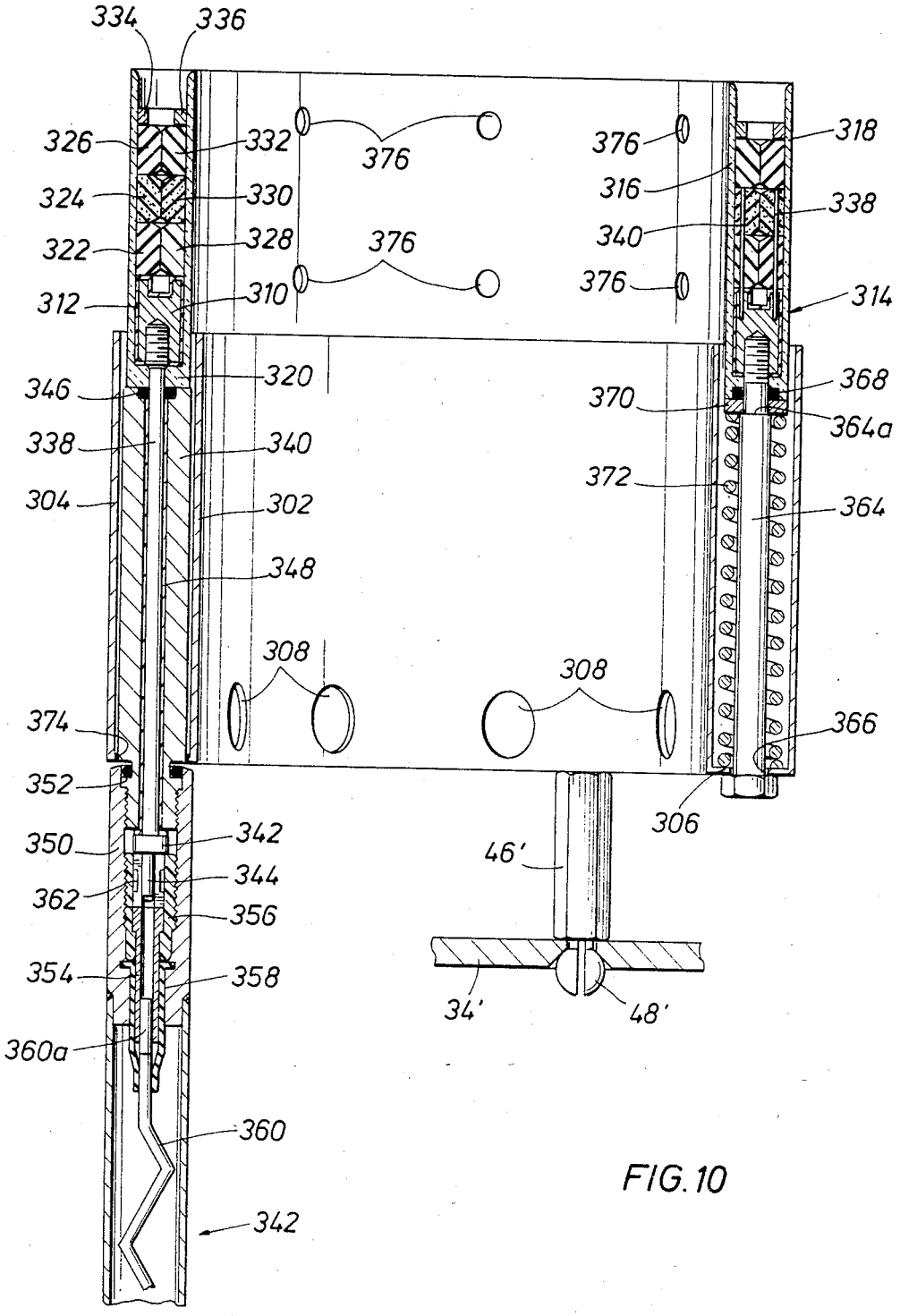
FIG. 10 is a view similar to that of FIG. 8 through the female coupler assembly of the second embodiment of the invention.

Referring now to FIGS. 8–10, there is shown a second embodiment of coupler assemblies according to the invention. FIG. 8 illustrates the male coupler assembly. This assembly includes a base structure comprising a thick rigid sleeve 226. Sleeve 226 has a pair of cut away areas one of which is shown at 228 for receiving the fitting 230 of a cable assembly 232. A nipple 234 formed integrally with sleeve 226 extends longitudinally into the cut away area 228 for attachment to fitting 230. Sleeve 226 also carries a set of standoff projections one of which is shown at 46 carrying a snap 48 for securing the coupler assembly to the shelf 34 of the mounting assembly. Members 46 and 48 of the coupler assembly of FIG. 8 are identical to the like-numbered elements of the embodiment of FIG. 2 except that projection 46 is secured to sleeve 226 by an integral threaded pin 236.

The contact means of the coupler assembly of FIG. 8 is defined by a generally rigid conductive contact ring having a thickened portion 238 and a sleeve-like portion 240 extending longitudinally from portion 238 intermediate its radially inner and outer extremities. Sleeve-like portion 240 has radially internal and external upset areas 242 and 244 respectively defining annular contact areas 246 and 248 on the surface of the contact ring. Upsets 242 and 244 are spaced slightly longitudinally inwardly from the free end of sleevelike portion 240, and the surfaces of the contact ring exclusive of contact areas 246 and 248 are encased by insulation 250. Accordingly, radially inner contact area 246 is interspersed longitudinally between two insulated areas 252 and 254 on the contact ring. Similarly, radially outer contact area 248 is interspersed longitudinally between insulated areas 256 and 258.

The insulated contact ring is further protected by a guard member 260. Guard member 260 is annular and generally U-shaped in cross section. The closed end of guard member 260 closely surrounds the insulated thickened portion 238 of the contact ring. The other end of guard member 260 comprises a pair of concentric cylindrical guard sleeves 262 and 264 extending generally along the radially inner and outer sides of sleevelike portion 240 of the contact ring, but spaced radially therefrom to define annular spaces for receipt of the female structure to be described below. Guard sleeves 262 and 264 have lateral ports 266 to allow drilling mud or other fluids or debris to escape from the interior of the guard member as it is engaged with such female structure. Guard sleeves 262 and 264 also serve to prevent personnel handling the apparatus from contacting areas 246 and 248 as well as to guide the female apparatus described below into proper position.

The sub-assembly comprised of the contact ring, its insulation, and its guard member is rigidly secured to the base structure or sleeve 226 by four epoxy bolts, one of which is shown at 268. Bolt 268 extends through a longitudinal bore 270 in sleeve 226 and aligned bores in guard member 260 and insulator 250 and has its tip end threaded into thickened portion 238 of the contact ring. A lock nut 272 and a washer 274 are interposed between the head of bolt 268 and the end of sleeve 226 opposite the male contact sub-assembly.

As mentioned above, nipple 234 provides for structural connection of the cable fitting 230 to sleeve 226. A conductive botl 276 is threaded into thickened portion 238 of the contact ring and extends through insulation 250 and guard member 260 and into and through a longitudinal bore in ring 226 extending though nipple 234. Externally of nipple 234 a radial flange 238 and a conductive pin 280 extend integrally from bolt 276. Except for the size and location of nipple 234, and the fact that it is formed as an integral extension of the base structure, rather than as a separate connecting sleeve, the cable assembly 232 is connected to pin 280 and nipple 234 in virtually the same manner that the cable assembly 50 is connected to members 116 and 126 in the embodiment of FIG. 2. Very briefly, fitting 230 has one end welded to one of a pair of telescoping shield tubes 282 of cable assembly 232. The other end of fitting 230 is threaded onto nipple 234 and sealed with respect thereto by an O-ring 284. Cable 284 has an uninsulated end 288 crimped in a socket at one end of a conductive link member 290, the other end of link member 290 forming a split socket engaging pin 280 and urged thereagainst by a spring band 292. Cable end 288 and link member 290 are insulated from fitting 230 by an elastomeric boot 294 and an insulator sleeve 296 threaded into fitting 230 and supporting link member 290. Bolt 276 is sealed with respect to ring 226 by an O-ring 298 and is further insulated from ring 298 by insulator sleeve 300.

Turning to FIG. 10, there is shown a female coupler assembly for use with the type of male coupler assembly shown in FIG. 8. The assembly of FIG. 10 includes an annular base structure similar to that of the embodiment of FIG. 3, and more specifically, comprising a pair of radially spaced apart, concentric, cylindrical walls 302 and 304 having their ends joined by an annular plate 306. Standoff projections 46' and snaps 48' identical to those of the embodiment of FIG. 3 are rigidly affixed to plate 306 in the same manner as those of FIG. 3 for releasably mounting the coupler assembly on shelf 34' of the mounting assembly. The base structure of FIG. 10 differs from that of FIG. 3 in that it includes lateral vent ports 308 through inner wall 302.

The coupler assembly further includes a rigid metallic contact ring 310. Ring 310 is encased in insulation 312 and rigidly mounted in a guard member 314. Guard 314 is somewhat similar to the guard member of the male coupler assembly in that it is annular and generally U-shaped in cross section, comprising a pair of concentric, radially spaced apart guard sleeves 316 and 318 the inner ends of which are joined by an annular base portion 320. However, guard member 314 is not metallic, but rather is comprised of a strong but non-conductive material such as an epoxy glass. The guard sleeves 316 and 318 extend longitudinally outwardly past contact ring 310 to house a plurality of elastomeric annuluses.

A first set of three such annuluses 322, 324 and 326 are mounted end-to-end adjacent the radially outer periphery of contact ring 310 against outer guard sleeve 318. A second or auxiliary set of annuluses 328, 330 and 332 are mounted adjacent the radially inner periphery of contact ring 310 against inner guard sleeve 316. The longitudinally innermost annuluses 322 and 328 are insulator annuluses which register with and radially abut each other. Middle annuluses 324 and 330 are both comprised of a conductive elastomer so that they may form a part of the contact means for the coupler assembly, and likewise register with and radially abut each other. Finally, longitudinally outermost annuluses 326 and 332 are insulator annuluses which register with and radially abut each other. A pair of retainer rings 334 and 336 in the form of spring clips are fixed to respective guard sleeves 318 and 316 by interference fits to retain the elastomeric annuluses within the guard member, retainer rings 334 and 336 being spaced apart by a distance sufficient to permit entry of the male contact means in the manner described below.

In order to provide for electrical connection between contact ring 310 and conductive annulus 324, a plurality of buss wires, one of which is shown at 338, are provided. Buss wire 338 extends through aligned longitudinal bores in conductive annulus 324, longitudinally inner insulator annulus 322, and insulation 312, and into a socket in contact ring 310. A similar set of buss wires, one of which is shown at 340, are provided to electrically connect auxiliary conductive annulus 330 with contact ring 310. Buss wires 338 and 340 are oversized with respect to the bores in their respective conductive annuluses 324 and 330 to insure good electrical contact. More specifically, the elastomeric nature of conductive annuluses 324 and 330 insures about 99% contact area providing a very low resistance connection.

A pair of cable assemblies, one of which is shown at 342, are connected to the coupler assembly of FIG. 10 in substantially the same manner as cable assembly 72 of the embodiment of FIG. 3. A conductive bolt 338 extends through bores in the base 320 of guard member 314 and insulation 312 and is threaded into contact ring 310. The shank portion of bolt 338 extends through the space between walls 302 and 304 surrounded by a connector sleeve 340. Bolt 338 and sleeve 340 extend through a bore 374 in plate 306 of the base structure of the coupler assembly. Still further beyond the outer end of sleeve 340 bolt 338 has an integral flange 342 for supporting connector sleeve 340 and a conductive pin 344 for making electrical contact with the cable assembly. Bolt 338 is sealed with respect to connector sleeve 340 by an O-ring 346 and is also insulated from sleeve 340 by an insulating sleeve 348 having a flange for disposition between the end of sleeve 340 and flange 342 on bolt 338. Cable assembly 342 has a fitting 350 which is threadedly connected to the end of sleeve 340 and sealed with respect thereto by an O-ring 352. A conductive link member 354 is supported within fitting 350 by an insulating sleeve 356 threaded into fitting 350. Sleeve 356 also abuts the flanged end of an elastomeric boot 358 which is also connected to cable 360 just beyond its uninsulated end **360*a*. End 360*a* of cable 360 is crimped in a socket in link member 354, and both cable end 360*a* and link member 354 are insulated from fitting 350 by boot 358 and sleeve 356. The opposite end of link member 354 defines a split socket receiving pin 344 on conductive bolt 338. A spring ring 362 surrounds the split socket to urge it into tight engagement with pin 344**.

As shown on the right hand side of FIG. 10, the subassembly comprised of guard member 314 and the parts mounted thereon is mounted on the base structure 302, 304, 306 for limited longitudinal, lateral, and circumferential play as well as tilting. Four epoxy bolts, one of which is shown at 364, serve as the carrier means for such mounting of the contact ring and associated parts. Bolt 364 extends through an oversized bore 366 in plate 306 of the base structure, through the space between walls 302 and 304, through bores in guard member 314 and insulation 312, and is threaded into contact ring 310. Bolt 364 is sealed with respect to guard member 314 by an O-ring 368. A washer-like ring 370 is disposed between the base 320 of guard member 314 and an opposed shoulder **364*a* on bolt 364 for abutting one end of a helical compression spring 372 surrounding bolt 364. The other end of spring 372 abuts plate 306 of the base structure. Thus, spring 372 and the other springs (not shown) similarly surrounding the other three epoxy bolts bias contact ring 310 and the connected parts longitudinally outwardly from the base structure. However, bolt 364 can slide longitudinally in bore 366 of the base structure, and the connecting sleeve 340 can likewise slide in oversized bore 374 to permit the contact ring and associated parts to telescope longitudinally inwardly with respect to the base structure. This helps to insure full mating contact of the male and female coupler assemblies while accomodating drill stem tolerances as explained above. Likewise, the clearance between springs 372 and connecting sleeves 340 and the walls 302 and 304 of the base structure, along with oversizing of bores 366 and 374**, allows for circumferential and lateral play as well as tilting of the contact ring, etc., with respect to the base structure, as needed for example when the connection between the tool joints in which the coupler assemblies are mounted is being made up.

FIG. 9 shows the male and female contact means of the coupler assemblies of FIGS. 8 and 10 in mating engagement. Comparing FIGS. 9 and 10, it can be seen that, prior to such mating engagement, the abutment of the longitudinally outer elastomeric insulator annuluses 326 and 322 with each other provides a seal, protecting conductive annuluses 324 and 330 from exposure to salt water, drilling fluid, debris, and the like. As the sleeve-like portion 240 of the male contact ring is inserted, elastomeric annuluses 322–328 will compress as shown in FIG. 9. During such insertion, the outermost insulator annuluses 326 and 332 will wipe contact areas 246 and 248 of the male contact ring, while sharp edges 378 formed on insulating casing 250 near the free end of sleeve-like portion 240 of the male contact ring will scrape and thereby clean the opposed surfaces of conductive annuluses 324 and 330. When the assemblies are engaged, as shown in FIG. 9, each of the contact areas 246 and 248 on the male contact ring will be in abutment with a respective one of the conductive annuluses 324 and 330 of the female assembly, and the compression of said conductive annuluses will help to insure a good electrical connection therebetween. The insulated areas on longitudinally opposite sides of contact areas 246 and 248 will likewise be in abutment with respective ones of the insulator annuluses 322, 326, 332 and 328 to seal off the contact areas. The guard sleeves 264 and 262 of the male assembly will generally encase and further protect the epoxy glass guard sleeves 316 and 318 of the female assembly. Lateral ports 266 in the male guard member and lateral ports 376 in the female guard member will allow venting of fluids as necessary during mating of the contact means. If the contact means are disconnected, as the male contact ring is being withdrawn from the elastomeric annuluses of the female assembly, said annuluses will expand to again abut one another as shown in FIG. 10 thereby continuing to protect the contact areas of annuluses 324 and 330 from exposure to undesirable fluids and debris.

Figure 11:
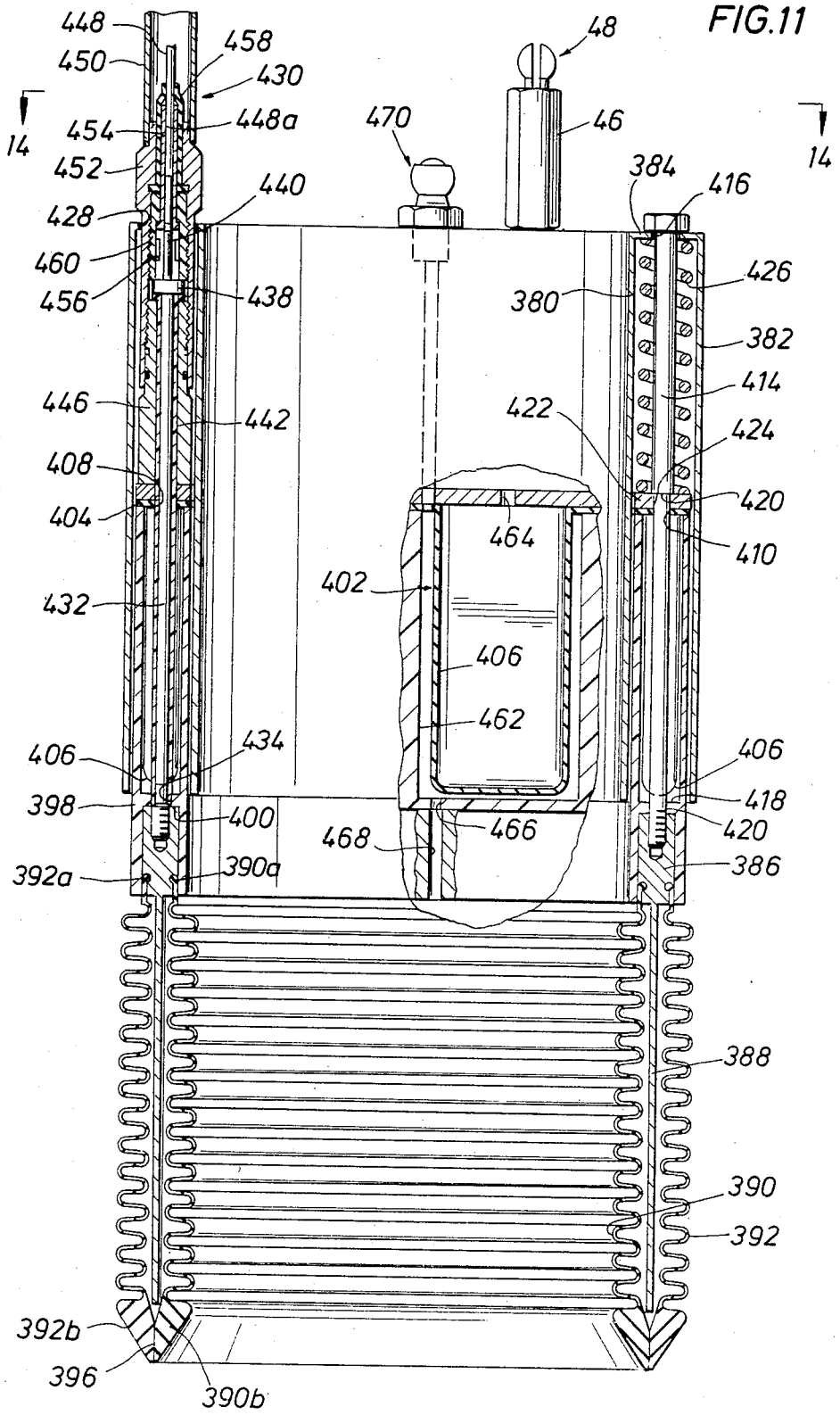
FIG. 11 is a longitudinal cross-sectional view taken along the line 11—11 in FIG. 14 through the male coupler assembly of a third embodiment of the present invention.

Referring finally to FIGS. 11 through 15, there is shown a third embodiment of the invention. FIGS. 11 and 14 show the male coupler assembly of that embodiment. The base structure of the male coupler assembly includes a pair of radially spaced apart, concentric, cylindrical walls 380 and 382 having their ends joined by an annular plate 384. Standoff projections 46 and snaps 48 identical to those of the embodiment of FIG. 2 are rigidly affixed to plate 384 in the same manner as those of FIG. 2.

The contact means of the coupler assembly of FIG. 11 comprises a conductive metal contact ring 386 having a thin integral sleeve 388 extending longitudinally therefrom between the radially inner and outer extremities. An annular half bellows 390 of elastomeric material has a retaining lip 398 disposed in a groove in the radially inner surface of contact ring 386 and extends longitudinally along the inner surface of sleeve 388 to a thickened tapered outer seal formation 390*b*, integral with the bellows and normally disposed longitudinally outwardly of the free end of sleeve 388 as shown in FIG. 11. A similar half bellows 392 has a retainer lip 392*a* disposed in a groove in the radially outer surface of contact ring 386 and extends longitudinally therefrom along the radially outer surface of sleeve 388 to a thickened, tapered seal formation 392*b* which abuts portion 390*b* of inner bellows 390 longitudinally outwardly of the end of sleeve 388. Bellows 390 and 392 are positioned such that, when abutting each other along the cylindrical locus 396, as shown in FIG. 11, they are compressed to form a seal at that locus. Also, outer bellows 392 is comprised of a somewhat softer elastomer than inner bellows 390, since the latter has lesser volume. This allows both bellows to have the same compressive strength, while having different volumes and diameters, and this in turn prevents seal formation 392*b* of the outer bellows from displacing formation 390*b* of the inner bellows radially inwardly, and thus, maintains seal area 396 in alignment with sleeve 388.

The assembly further comprises a generally cylindrical carrier 398 comprised of a rigid insulating type material such as a suitable plastic. Contact ring 386 is rigidly mounted in an annular recess 400 extending longitudinally into carrier 398 from one end thereof so that carrier 398 abuts the retaining lips 390*a* and 392*a* of the bellows to maintain them in their respective grooves in the contact ring 386, the remainder of the bellows and the enlosed contact sleeve 388 extending longitudinally away from the open end of recess 400.

The end of carrier 398 opposite recess 400 has an annular longitudinal recess 418. That end of carrier 398 extends into the area of the base structure defined between walls 380 and 382 and abuts the flange portion 404 of a flexible diaphragm member 402 shown more clearly in FIG. 15. The flange portion 404 of diaphragm 402 is generally flat and annular. A plurality of circumferentially spaced pockets 406 extend longitudinally from flange portion 404. Flange 404 also has a plurality of holes 408, 410, and 412 extending therethrough in the locations between pockets 406, for purposes to be described more fully below.

The carrier 398, contact ring 386, and attached parts are mounted on base structure 380, 382, 384 by means of six epoxy bolts, one of which is shown at 414. Bolt 414 extends through an oversized bore 416 in plate 384, through the space between walls 380 and 382, through recess 418 in carrier 398, through a hole 420 in carrier 398 connecting recesses 418 and 400, and has its end threaded into contact ring 386. The shank portion of bolt 414 has a shoulder 420 which, together with similar shoulders on the other five epoxy bolts, supports an annular plate 422 disposed in the space between walls 380 and 382 and having a bore 424 for receipt of bolt 414. Plate 422 abuts flange 404 of diaphragm 402, the other side of which is engaged by the end of carrier 398. In other words, both plate 422 and flange 404 are clamped between shoulder 420 and the adjacent end of carrier 398.

Accordingly, plate 422 not only forms a means for sealing diaphragm flange 404 with respect to the adjacent end of carrier 398, but also provides a shoulder extending radially from bolt 414 for abutting one end of a compression spring 426, which surrounds bolt 414. The other end of spring 426 abuts plate 384 to urge carrier 398, the contact means 386, 388, and other attached parts longitudinally away from plate 384, while permitting longitudinal play of said contact means with respect to the base structure. There is sufficient clearance between the walls 380 and 382, on the one hand, and the spring 426, plate 422, carrier 398, and the cable connection parts to be described below, on the other, to also permit lateral play and tilting of those parts and the attached contact means with respect to the base structure. Bores 416 and 428 in plate 384 are also oversized sufficiently to permit such play.

The coupler assembly is attached to two cable assemblies, one of which is shown at 430, in much the same way that the cable assemblies are attached to the coupler assemblies of the embodiments described above. More specifically, a conductive bolt 432 has one end threaded into contact ring 386, and extends through a hole 434 in carrier 398 and into recess 418. Bolt 332 extends out through carrier 398 through hole 408 in diaphragm flange 404 and through an aligned hole in plate 322. The other end of bolt 432 has formed integrally therewith a radial flange 438 and a conductive pin 440. From contact ring 386 to flange 438, bolt 432 is insulated by a sleeve 442. A tubular nipple or connecting sleeve 446 surrounds sleeve 432 between plate 422 and flange 438.

Cable assembly 430 includes a cable proper 448 surrounded by a pair of telescoping shield tubes, one of which is shown at 450. Tube 450 is welded to a tubular fitting 452. Fitting 452 extends through oversized bore 428 in plate 384 and is threaded to nipple 446. Cable 448 has an uninsulated end portion 448*a*. A conductive link member 454 has a socket at one end crimped about cable end 448*a* and a split socket at the other end urged about pin 440 of the coupler assembly by a spring ring 456. Cable end 448*a* is insulated by an elastomeric boot 458, which also serves to insulate a portion of link member 454 from fitting 452. The remainder of link member 454 is insulated by a rigid insulator sleeve 460 which is threaded into fitting 452 and which also abuts a flanged end of the boot 458 therein to retain the boot in place.

In addition to bolts 414 and 432, recess 418 of carrier 398 receives the pockets 406 of diaphragm 402. The bolts 414 and 432 extend through the spaces between pockets 406. Plate 422 has a plurality of bores 464, each communicating with a respective one of the diaphragm pockets 406, whereby the interiors of those pockets are exposed to the pressure of the fluid environment of the coupler assembly. The opposite side or exterior of each diaphragm pocket 406 is exposed to the pressure within the carrier recess 418, which in turn communicates via bores 466 and 468, in carrier 398 and contact ring 386 respectively, with the space between bellows 390 and 392. This space is filled with a suitable fluid lubricant, which is injected and replenished as needed through a grease fitting 470. This arrangement permits the pressure within bellows 390 and 392 to be maintained equal to that in the external environment of the coupler assembly. This in turn insures that the bellows will not separate, but rather, will provide a seal protecting contact sleeve 388 from exposure to the external environment of the coupler assembly.

Figures 12, 13:
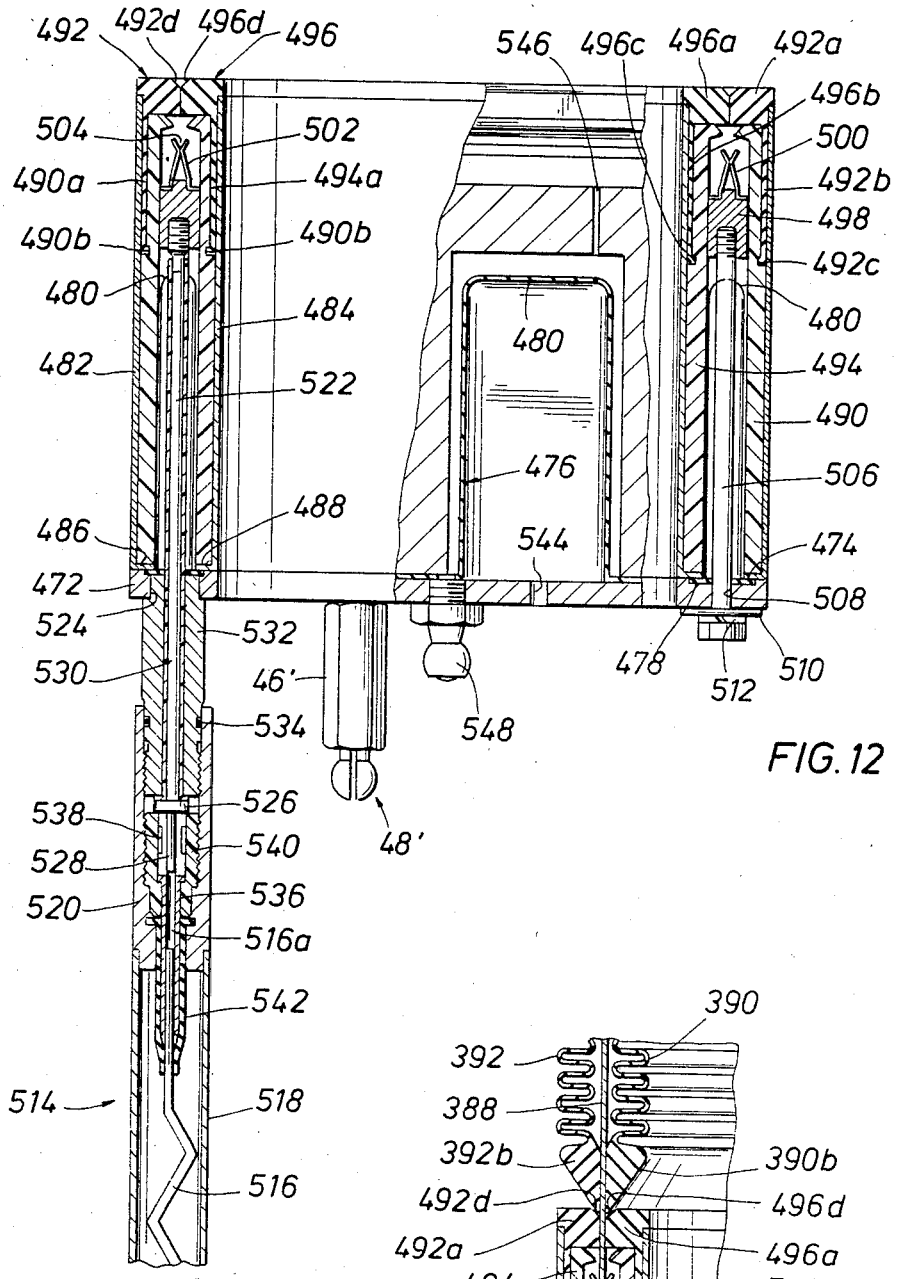
FIG. 12 is a view similar to that of FIG. 11 through the female coupler assembly of the third embodiment of the invention.
FIG. 13 is a detailed sectional view showing the contact means of FIGS. 11 and 12 in mating engagement.

Referring now to FIG. 12, there is shown a female coupler assembly designed for mating engagement with the male coupler assembly in FIG. 11. The base structure of the female coupler assembly includes a fixed base plate 472. A set of standoff projections 46' carrying snaps 48' are rigidly secured to plate 472 for releasably securing the coupler assembly to the mounting assembly. One of the flat longitudinally facing surfaces of plate 472 is countersunk as indicated at 474 to receive the annular flange portion 478 of a diaphragm 476. Diaphragm 476 is similar to the diaphragm 402 of the male coupler assembly in that it is elastomeric and, in addition to flange portion 478, includes a plurality of circumferentially spaced pockets 480 extending longitudinally from flange portion 478. In addition to plate 472, the base structure of the coupler assembly of FIG. 12 also includes a pair of cylindrical walls 482 and 484 welded to the countersunk base of ring 472 so as to extend longitudinally therefrom adjacent the radially outer and inner extremities respectively of plate 472. Thus walls 482 and 484 are disposed in concentric, spaced apart relation. Wall 482 has an annular flange 486 extending radially inwardly therefrom adjacent plate 472, while wall 484 has a similar flange 488 extending radially outwardly therefrom. Flanges 486 and 488 overlie flange portion 478 of diaphragm 476 to retain it in the countersunk area 474 of plate 472.

A rigid sleeve 490 of insulating material is bonded to the inner surface of wall 482 and extends from flange 486 to a point just inwardly of the free end of wall 482. Adjacent said free end of wall 482, sleeve 490 has its outer diameter reduced, as indicated at 490*a*, and is further recessed as indicated at 490*b* adjacent the juncture of its large and small outer diameter portions. An annulr elastomeric sealing element 492 has a thickened end portion 492*a* configured to overlie the free end of wall 482 and extend radially and longitudinally inwardly therefrom, such that is also overlies and extends radially inwardly beyond the outer or free end of sleeve 490. Sealing element 492 also has a thin sleeve-like portion 492*b* formed integrally with portion 492*a* and extending into the space between wall 482 and small diameter portion 490*a* of sleeve 490. The sealing element 492 further has a small flange 492*c* extending radically inwardly into recess 490*b* of sleeve 490 whereby the sealing element is retained in the position shown.

Similarly, a sleeve 494 of insulating material is bonded to the radially outer surface of wall 484 of the base structure and extends parallel to sleeve 490. Sleeves 490 and 494 are radially spaced apart by a distance sufficient to accommodate pockets 480 of diaphragm 476, as well as other structures to be described below. Near the longitudinally outer or free end of wall 484, sleeve 494 has an increased inner diameter as indicated at 494*a* whereby that portion of sleeve 494 is spaced from wall 484 to receive a thin sleeve-like portion 496*b* of an annular sealing element 496. Sealing element 496 has a thickened end portion 496*a* which extends radially inwardly across the free ends of wall 484 and sleeve 494 and therebeyond to sealingly abut the corresponding portion 492*a* of sealing element 492. Sleeve 490 has a recess 490*b* at the juncture of its large and small diameter portions which receives a flange 496*c* on sealing element 496 to retain the latter in place.

The contact means comprises a contact ring 498 bonded between sleeves 490 and 494 and a pair of conductive annular springs 500 and 502. The springs 500 and 502 are carried by the ring 498 and extend longitudinally therefrom toward the abutting thickened portions 496*a* and 492*a* of the sealing elements. Springs 500 and 502 are bent toward each other and also biased toward each other so that they normally abut along a circular locus 504 at the apexes of their respective bends, but are yieldable to permit entry of the male contact therebetween as shown in FIG. 13.

Contact ring 498 is further secured to the base structure by a set of epoxy bolts, one of which is shown at 506. Bolt 506 has its head disposed outwardly of plate 472, and its shank extends through a bore 508 in that plate and through the space between sleeves 490 and 494, its tip being threaded into ring 498. A flat washer 510 and a lock washer 512 are disposed between the head of bolt 506 and plate 472 to retain the bolt in proper position.

Electrical connection between contact ring 498 and a pair of cable assemblies, one of which is shown at 514, is provided in substantially the same manner as the preceding embodiments. The cable assembly 514 includes the cable proper 516 and a pair of telescoping shield tubes, one of which is shown at 518. A connection fitting 520 is welded or otherwise rigidly affixed to the end of tube 518. A conductive bolt 522 has one end threaded into contact ring 498 and extends therefrom through the space between two of the pockets 480 of the diaphragm and out through an opening 524 in plate 472. Integrally formed on the outer end of bolt 522 are an annular flange 526 and a conductive pin 528. From flange 526 to contact ring 498, bolt 522 is insulated by a sleeve 530. A nipple 532 has a reduced diameter portion fitted into opening 524 and extends longitudinally therefrom away from plate 472. Nipple 532 is supported by flange 526 and is externally threaded to provide an attachment site for fitting 520 of the cable assembly. Nipple 532 also carries an O-ring 534 for sealing against fitting 520. Cable 516 has an uninsulated end 516*a* disposed within fitting 520. One end of a tubular conductive link member 536 is crimped about cable end 516*a*. The other end of link member 536 forms a split socket receiving conductive in 528 and held tightly thereabout by a spring ring 538. Link member 536 is retained in fitting 520 and partially insulated therefrom by a sleeve 540 threaded into fitting 520. Sleeve 540 also retains an elastomeric boot 542 with respect to fitting 520, boot 542 serving to insulate the remainder of link member 536 and the uninsulated end 516*a* of the cable from fitting 520.

Plate 472 of the base structure is provided with bores 544 for providing communication between the external environment of the coupler assembly and the interiors of diaphragm pockets 480. The space adjacent the exteriors of pockets 480 communicates through ports 546 in contact ring 498 with the area about contact springs 500 and 502, this area being sealed from the external environment of the coupler assembly by sealing elements 492 and 496. The latter area is also filled with a suitable lubricant fluid through a grease fitting 548. Thus, the provision of the flexible diaphragm 476, having one side exposed to the aforementioned lubricant-filled space and the other side exposed to the pressure of the environment of the coupler assembly, provides for pressure equalization between those two areas thereby preventing leakage of high pressure fluid from the external environment between sealing elements 492 and 496 into the sealed area.

As a pair of tool joints, one carrying the assembly of FIG. 11 and the other carrying the assembly of FIG. 12, are threadedly connected, the male contact sleeve 388 will approach the female coupler assembly. Thickened portions 496*a* and 492*a* of the sealing elements of the female assembly are bevelled near their abutting or interface surfaces as indicated at 492*d* and 496*d* to engage the tapered ends of seal formation 390*b* and 392*b* on the male assembly to help properly position the two assemblies. As the assemblies are urged closer together, seal formations 390*b* and 392*b* will skin back along male contact sleeve 388, while the latter is forced between the thickened portions 492*a* and 496*a* of the sealing elements of the female assembly so that it can engage the female contact springs 500 and 502 as shown in FIG. 13. During such action, both the seal formations 390*b* and 392*b* and the thickened portions 492*a* and 496*a* remain sealingly engaged against the sides of the contact sleeve 388 so that the latter, as well as the female contact means disposed inwardly of thickened seal element portions 392*a* and 396*a*, remain constantly protected against exposure to the external environment of the coupler assemblies. Thickened portions 492*a* and 496*a* and seal formations 390*b* and 392*b* also perform a wiping function with respect to contact sleeve 388. Diaphragm 402 of the male coupler assembly can flex to accommodate the dispursement of the lubricant enclosed within the main coupler assembly caused by flexing of the bellows 390 and 392. Likewise, diaphragm 476 of the female coupler assembly can flex to accommodate fluid displacement caused by entry of the contact sleeve 388 into the sealed area of the female coupler assembly.

Numerous modifications of the preferred embodiments described above can be made within the scope of the present invention. Accordingly, it is intended that the scope of the invention be limited only by the claims which follow.

We claim:

1. Electrical communication apparatus suitable for use in a section of well conduit, comprising:

a generally annular male electrical coupler assembly comprising a first base structure for rigid connection to a first end of said section of said well conduit and first annular electrical contact means carried by said first base structure;

first mounting means associated with said male coupler assembly for releasably mounting said first base structure of said male coupler assembly generally coaxially in said first end of said section of said well conduit;

a generally annualar female electrical coupler assembly comprising a second base structure for rigid connection to a second end of said section of said well conduit and second annular electrical contact means carried by said second base structure;

second mounting means associated with said female coupler assembly for releasably mounting said base structure of said female coupler assembly generally coaxially in said second end of said section of said well conduit;

the contact means of at least one of said coupler assemblies being mounted for limited lateral and circumferential play with respect to its base structure; and electrical transfer means interconnecting said male and female coupler assemblies, said transfer means comprising an electrical cable electrically connected to each of said coupler assemblies for conducting electric current therebetween.

2. The apparatus of claim 1 wherein said transfer means is longitudinally extendable and retractable to accommodate relative movement between said coupler assemblies.

3. The apparatus of claim 2 wherein said transfer means comprises longitudinally extendable and retractable outer shield tube means encasing the major portion of said cable, said cable being folded upon itself within said shield tube means.

4. The apparatus of claim 3 wherein said shield tube means comprises at least two telescoping shield tubes.

5. The apparatus of claim 4 wherein said shield tubes are comprised of a material of sufficient rigidity to retain said cable in laterally spaced relation to the center lines of the bores of said coupler assemblies.

6. The apparatus of claim 3 comprising two such transfer means providing duplicate electrical paths between said coupler assemblies.

7. The apparatus of claim 3 wherein said shield tube means is structurally connected to each of said coupler assemblies independently of the electrical connections between said cable and said coupler assemblies, whereby forces imposed on said shield tube means may be transferred to said coupler assemblies without imposition of substantial forces on said cable.

8. The apparatus of claim 1 wherein said one coupler assembly comprises means resiliently biasing said contact means longitudinally outwardly from said base structure and yieldable to permit limited longitudinal play between said contact means and said base structure.

9. The apparatus of claim 1 wherein each of said base structures is releasably connectable to the respective one of said mounting means.

10. The apparatus of claim 9 comprising snap and socket means cooperative between each of said base structures and the respective mounting means for so releasably connecting said base structure and mounting means.

11. The apparatus of claim 10 wherein said snap means is carried by said base structure and comprises a plurality of circumferentially spaced snap elements projecting longitudinally from said base structure, each such snap element comprising a widened detent end portion split to form a plurality of laterally deflectable fingers, and a narrow neck portion connecting said detent end portion to said base structure; said mounting means comprising generally laterally extending shelf means, said socket means comprising a plurality of longitudinal bores in said shelf means, the width of said bores being greater than that of said neck portions but less than that of said detent end portions of said snap elements in a relaxed position.

12. The apparatus of claim 1 wherein each of said mounting means is adapted for connection to said section of well conduit by a frictional interference connection.

13. The apparatus of claim 12 wherein each of said mounting means comprises a split grip sleeve and means for radially expanding said grip sleeve against the interior of said section of well conduit.

14. The apparatus of claim 13 wherein said expanding means comprises wedge means cooperative with the split edges of said grip sleeve.

15. The apparatus of claim 14 wherein said grip sleeve includes a pair of generally opposed, radially inwardly projecting convolutions.

16. The apparatus of claim 15 wherein said transfer means comprises a pair of cables extending longitudinally through respective ones of the convolutions of each of said grip sleeves.

17. The apparatus of claim 1 further comprising said section of well conduit, said male coupler assembly being so mounted in said one end of said section of well conduit, and said female coupler element being so mounted in said other end of said section of well conduit, said male coupler assembly being positioned to automatically matingly engage a female coupler assembly in a second section of said well conduit when said second section is connected to said one section, and said female coupler of said one section of well conduit being positioned to automatically matingly engage a male coupler assembly of a third section of said well conduit when said one section and said third section are connected to each other.

18. A male electrical coupler assembly comprising:

a base structure;

a male contact carried by said base structure and extending generally longitudinally therefrom, said male contact having an engagement end for abutment with and direct electrical connection to a female contact; and resilient seal means comprising a split bellows cooperating with said male contact, said bellows including inner and outer halves comprised of elastomeric materials of differing compressive strengths, said seal means connected to said base structure and enveloping said engagement end of said male contact, said seal means having a split end seal separable to sealingly engage the sides of said male contact while retracting longitudinally from said engagement end as said engagement end passes through said split end seal, said seal means being resiliently biased longitudinally outwardly to tend to return to a position enveloping said engagement end of said male contact.

19. The assembly of claim 18 wherein said base structure defines with said seal means a contact housing area generally surrounding said male contact, said assembly further including pressure equalization means for equalizing the pressure within and without said housing area.

20. The assembly of claim 19 wherein said pressure equalization means comprises a diaphragm separating said housing area from the exterior of said coupler assembly and a fluid substance filling said housing area.

21. A female electrical coupler assembly comprising:

a base structure;

an annular female contact having an engagement portion for abutment with and direct electrical connection to a male contact;

guard means connected to said base structure and extending along the sides of said engagement portion of said female contact; and elastomeric seal means comprising a pair of concentric elastomeric bodies radially abutting each other, said seal means adjoining said guard means and defining an access opening generally longitudinally aligned with said engagement portion of said female contact, said access opening being an annular opening located at the abutment interface of said bodies and being normally closed by self abutment of said elastomeric seal means in overlying relation to said engagement portion of said female contact, and said elastomeric seal means being compressible to open said access opening and permit access of a male contact to said female contact while sealingly engaging the sides of said male contact.

22. The assembly of claim 21 wherein said base structure defines with said guard means and said elastomeric seal means a contact housing area generally surrounding said female contact, said assembly further comprising pressure equalization means for equalizing the pressure within and without said housing area.

23. The assembly of claim 22 wherein said pressure equalization means comprises a diaphragm separating said housing area from the exterior of said coupler assembly and a fluid substance filling said housing area.

24. Electrical coupler apparatus for making electrical connections on a tubular conduit comprising:

(a) a first electrical coupler assembly including, a first base structure for structural connection to said tubular conduit;

male contact means carried by and insulated from said first base structure; and (b) a second electrical coupler assembly including, a second base structure for structural connection to said tubular conduit;

female contact means carried by and insulated from said second base structure, wherein the contact means of one of said coupler assemblies is mounted for limited lateral and circumferential play with respect to its respective base structure.

25. The apparatus of claim 24 wherein said one coupler assembly comprises means resiliently biasing said contact means longitudinally outwardly from said base structure and yieldable to permit limited longitudinal play between said contact means and said base structure.

26. The apparatus of claim 25 wherein said one coupler assembly comprises carrier means rigidly connected to said contact means and mounted for generally telescopic type longitudinal movement with respect to said base structure; said resilient biasing means comprising spring means cooperative between said carrier means and said base structure.

27. Electrical coupler apparatus for making electrical connections on a tubular conduit comprising:

(a) a first electrical coupler assembly including, a generally annular first base structure for structural connection to said tuular conduit;

annular male contact means carried by said first base structure, generally coaxial with said first base structure, extending generally longitudinally from said first base structure and insulated from said first base structure;

wherein said male contact means comprises a generally rigid contact ring having an uninsulated annular contact area on its radially outer surface interposed longitudinally between two insulated annular areas on said outer surface; and (b) a second electrical coupler assembly including, a generally annular second base structure for structural connection to said tubular conduit;

annular female contact means carried by said second base structure, generally coaxial with said second base structure, extending generally longitudinally from said second base structure, and insulated from said second base structure;

wherein said female contact means comprises a generally rigid contact ring having an uninsulated annular contact area on its radially inner surface interposed longitudinally between two insulated annular areas on said inner surface and positioned to be generally concentric with and abutting said contact area of said male contact means when said contact means are so matingly engaged, said female contact means further comprising a conductive annulus mounted on said rigid contact ring in electrical communication therewith and defining said contact area of said female contact means, said conductive annulus being radially resiliently yieldable for permitting passage of said male contact means thereinto and for firmly engaging said male contact means.

28. The apparatus of claim 27 wherein said conductive annulus is comprised of a conductive elastomeric material.

29. The apparatus of claim 28 wherein said two insulated areas on said inner surface of said female contact means are defined by two elastomeric insulator annuluses mounted on said rigid contact ring on longitudinally opposite sides of said conductive annulus.

30. The apparatus of claim 29 wherein the longitudinally outermost of said two insulator annuluses has an inner diameter sized to permit said outermost insulator annulus to wipe said contact area of said male contact means as said contact means are so matingly engaged.

31. The apparatus of claim 30 wherein said female contact means further comprises one auxiliary annular elastomeric insulator mounted on said rigid contact ring and concentrically surrounded by said longitudinally outer one of said insulator annuluses; said outer insulator annulus and said auxiliary insulator abutting each other when said contact means are not matingly engaged to seal said conductive annulus from the exterior of said female contact means, and further sealing against respective opposite sides of said male contact means during such sealing engagement.

32. The apparatus of claim 31 wherein said female contact means further comprises an auxiliary annular elastomeric conductor mounted on said rigid contact ring in electrical communication therewith and concentrically surrounded by said conductive annulus; said male contact means having an uninsulated annular contact area on its radially outer surface defined by said rigid contact ring of said male contact means, and interspersed longitudinally between two insulated annular areas on said outer surface and positioned for abutment with said auxiliary elastomeric conductor when said contact means are matingly engaged.

33. The apparatus of claim 32 wherein said female contact means further comprises another auxiliary annular elastomeric insulator mounted on said rigid contact ring and concentrically surrounded by the longitudinally inner one of said insulator annuli.

34. The apparatus of claim 33 further comprising an inner guard sleeve adjoining said rigid contact ring of said female contact means overlying the radially inner surfaces of said auxiliary insulators and conductor, and an outer guard sleeve adjoining said rigid contact ring of said female contact means and overlying the radially outer surfaces of said conductive and insulator annuli.

35. The apparatus of claim 34 further comprising inner and outer guard sleeves adjoining said rigid contact ring of said male contact means parallel to said rigid contact ring, but spaced therefrom in opposite radial directions by a distance sufficient to receive said guard sleeves of said female contact means when said contact means are matingly engaged.

36. The apparatus of claim 35 wherein said guard sleeves of said male contact means have lateral vent ports.

37. The apparatus of claim 28 wherein said rigid contact ring of said female contact means concentrically surrounds said conductive annulus and is in direct electrical contact therewith.

38. The apparatus of claim 27 wherein said rigid contact ring of said male contact means is insulated along its radially inner surface.

39. Electrical coupler apparatus for making electrical connections on a tubular conduit comprising:

(a) a first electrical coupler assembly including, a first base structure for structural connection to said tubular conduit; p1 male contact means carried by and insulated from said first base structure; and (b) a second electrical coupler assembly including, a second base structure for structural connection to said tubular conduit;

female contact means carried by and insulated from said second base structure, wherein said female contact means has an engagement portion for abutment with and direct electrical connection to said male contact means, said second coupler assembly further comprising guard means extending along the radially inner and outer sides of said egagement portion of said female contact means, a pair of elastomeric bodies adjoining said guard means, said elastomeric bodies being concentric and radially abutting each other along a locus generally longitudinally aligned with said engagement portion of said female contact means to seal said engagement portion from the exterior of said guard means when said contact means are not matingly engaged, said elastomeric bodies further sealing against respective opposite sides of said male contact means when said contact means are matingly engaged.

40. The apparatus of claim 39 wherein said engagement portion of said female contact means comprises a pair of concentric annular conductors resiliently biased radially toward each other.

41. The apparatus of claim 40 wherein said annular conductors are comprised of spring metal.

42. The apparatus of claim 39 wherein said male contact means has an engagement end for abutment with and direct electrical connection to said engagement portion of said female contact means, said first coupler assembly further comprising resilient seal means enveloping said engagement end of said male contact means and having a split end seal separable to sealingly engage the radial sides of said male contact means while retracting longitudinally from said engagement end for mating engagement of said contact means, said seal means being resiliently biases longitudinally outwardly to return to a position enveloping said engagement end of said male contact means when said contact means are disengaged.

43. The apparatus of claim 42 wherein said seal means comprises split annular bellows means.

44. The apparatus of claim 43 wherein inner and outer halves of said split annular bellows means are comprised of elastomeric materials of differing compressive strengths.

45. The apparatus of claim 42 wherein said base structure of said first coupler assembly defines with said seal means a first contact housing area generally surrounding said male contact means; said base structure of said second coupler assembly defining with said guard means and said elastomeric bodies a second contact housing area generally surrounding said female contact means; and wherein each of said coupler assemblies include pressure equalization means for equalizing the pressure within and without said housing area.

46. The apparatus of claim 45 wherein each of said pressure equalization means comprises a diaphram separating said housing area from the exterior of said coupler assembly and a substantially incompressible fluid substance filling said housing area.

* * * * *